US006925691B2

(12) United States Patent
Bristel

(10) Patent No.: US 6,925,691 B2
(45) Date of Patent: Aug. 9, 2005

(54) ERGONOMIC NON-RECOILING SECURE BELT WORN POUCH

(76) Inventor: Susan Bristel, 3 Troy Pl., Merrick, NY (US) 11566

( * ) Notice: Subject to any disclaimer, the term of this patent is extended or adjusted under 35 U.S.C. 154(b) by 0 days.

(21) Appl. No.: 10/370,647

(22) Filed: Feb. 20, 2003

(65) Prior Publication Data

US 2004/0164115 A1 Aug. 26, 2004

(51) Int. Cl.[7] ..... A45C 1/04; A45F 3/00; F41C 33/02; F40B 39/02

(52) U.S. Cl. ..... 24/673; 224/674; 150/102; 150/134

(58) Field of Search ..... 224/674, 240, 224/665, 671–673; 150/102, 134

(56) References Cited

U.S. PATENT DOCUMENTS

| | | | | | |
|---|---|---|---|---|---|
| 601,725 | A | | 4/1898 | Zeugschmidt | |
| 686,885 | A | | 11/1901 | Blust | |
| 1,416,238 | A | | 5/1922 | Seiler | |
| D67,549 | S | | 6/1925 | Rohr | |
| 1,651,921 | A | * | 12/1927 | Felz | 224/240 |
| 2,317,820 | A | * | 4/1943 | Smith | 224/235 |
| 2,324,194 | A | | 7/1943 | Campiglia | 224/5 |
| 2,392,533 | A | * | 1/1946 | Isaac | 224/221 |
| 2,474,495 | A | * | 6/1949 | Pollak | 224/245 |
| 2,983,412 | A | | 5/1961 | Ferguson | 224/26 |
| 3,147,896 | A | * | 9/1964 | Kehl | 224/240 |
| 3,158,300 | A | * | 11/1964 | Withee | 224/235 |
| 3,361,312 | A | | 1/1968 | Hutchison | 224/26 |
| 3,949,916 | A | | 4/1976 | Yount | 224/26 R |
| 4,000,769 | A | | 1/1977 | Katz | 150/52 J |
| 4,046,296 | A | * | 9/1977 | McGhee | 224/626 |
| 4,139,914 | A | * | 2/1979 | Tarr | 2/247 |
| 4,434,921 | A | * | 3/1984 | Santhoff | 224/674 |
| 4,444,342 | A | * | 4/1984 | Powell | 224/667 |
| 4,796,790 | A | | 1/1989 | Hamilton | 224/253 |
| 4,801,059 | A | | 1/1989 | Hayes | 224/240 |
| 4,878,606 | A | | 11/1989 | Miller | 224/208 |
| 4,893,739 | A | * | 1/1990 | Conner | 224/240 |
| 4,998,653 | A | | 3/1991 | LaBelle | 224/151 |
| 5,244,136 | A | * | 9/1993 | Collaso | 224/673 |
| 5,255,835 | A | | 10/1993 | Burks | 224/228 |

FOREIGN PATENT DOCUMENTS

| | | | | |
|---|---|---|---|---|
| DE | 3804030 A1 | * | 8/1989 | A61F/9/00 |
| JP | 9056568 A | * | 3/1977 | |

OTHER PUBLICATIONS

"Like it? Find it here . . . " Avignon Brown equestrian bag, Dooney & Bourke tan pocket bag and Longchamp Red Pocket Bag, Shopping Details, Good Housekeeping, Mar. 2003, p. 222.

*Primary Examiner*—Sue A. Weaver
(74) *Attorney, Agent, or Firm*—Alfred M. Walker

(57) ABSTRACT

An ergonomic, non-recoiling belt worn lower abdominal pouch stays securely in place without bouncing and recoiling, and is secure from theft. The lower abdominal pouch includes a front panel joined at a bottom edge thereof and along two side edges to a rear panel, forming an open pocket therebetween with a top entry. Each panel is made of a flexible fabric or other synthetic or natural substrate material, such as canvas, leather and the like. The lower abdominal pouch is carried upon the wearer by being supported by the wearer's belt, which belt slides into a rear wall of the lower abdominal pouch, through a vertically extending button hole slot thereof and exits at a second button hole slot of a preferable outer rear wall in front of a preferable inner rear wall of the rear panel, thereby optionally providing a seal between the outer rear wall having the two open button hole slots for accommodating the user's belt therein.

11 Claims, 5 Drawing Sheets

U.S. PATENT DOCUMENTS

| | | | | | |
|---|---|---|---|---|---|
| 5,285,833 | A | | 2/1994 | Haxby | 150/102 |
| 5,292,042 | A | | 3/1994 | Yamaguchi | 224/159 |
| D354,619 | S | | 1/1995 | Soukeras | D3/217 |
| D358,705 | S | | 5/1995 | Saggese, Jr. | D3/226 |
| D360,073 | S | | 7/1995 | Schrader | D3/226 |
| 5,465,889 | A | | 11/1995 | Smith | 224/224 |
| 5,551,496 | A | * | 9/1996 | Gray, Jr. | 150/134 |
| 5,873,505 | A | * | 2/1999 | Sovitski | 224/576 |
| D440,041 | S | | 4/2001 | Fermin | D3/226 |
| 6,209,769 | B1 | | 4/2001 | Seals | 224/583 |
| 6,345,752 | B1 | * | 2/2002 | Chapman | 224/674 |
| 2002/0113107 | A1 | * | 8/2002 | Hartranft et al. | |
| 2004/0164115 | A1 | * | 8/2004 | Bristel | |

* cited by examiner

ERGONOMIC NON-RECOILING SECURE BELT WORN POUCH

BACKGROUND OF THE INVENTION

1. Field of the Invention

This invention relates to article carriers. In particular, the present invention relates to a belt-worn lower abdominal pouch that provides for the user, secure, comfortable and ergonomic access to the contents of the pouch.

2. Description of the Prior Art

Article carriers have been designed for carrying valuable objects such as money, keys, identification, credit cards, passports, and the like. Typically, these items are carried in either a purse suspended from a shoulder or in a wallet placed in a pant pocket. However, wallets and purses are extremely vulnerable to theft. They can also become cumbersome to the user who needs to retrieve an item quickly. Pouches that are suspended from shoulders must be constantly monitored and adjusted to keep them in place. As the user walks, the pouch swings away from the body and eventually pulls the strap off the shoulder. Because of this, the freedom of the user's hands is greatly reduced and the ability to walk or run is hampered.

Several article carriers have been designed for carrying an array of personal items. For example, U.S. Pat. No. 4,998,653 discloses a body-attachable concealable pouch. The invention includes a belt that slides through back channels of the pouch and secures in the back of the person. However, by securing the pouch behind the user, this invention also becomes vulnerable to theft.

U.S. Pat. No. 6,209,769 discloses a side pack that includes 2 loops that allow the pack to suspend from the user's belt. However, over time, the weight of the objects contained in the pouch would weaken the loops. Therefore, the claim of security is reduced. In addition, because the side pack suspends in a vertical position, the claim of comfort is also reduced. When walking, the side pack would swing away from the body. For each outward swing, there would be a return collision. These continual collisions with the side pack are annoyances and has a negative affect upon the user's ability to walk or run while wearing the side pack. Finally, the contents of the main compartment are not held securely since the opening is only partially covered by a closing flap.

In addition, when traveling, especially overseas, it is beneficial to minimize weight of a purse, but have the purse large enough to carry a passport, hotel keys, frequently of the flat electronic card activated type, a health insurance card, a few world-recognized credit cards and local currency.

It is also beneficial to carry the pouch in an anatomically convenient position in the lower front torso area, thereby minimizing theft from sly and quick pickpocketers, who can easily and unobtrusively access rear or side mounted pouches, even if worn on a belt.

However, the lower front torso area has size and anatomical limitations, which limit the size of a pouch worn thereat. For example, when a person is seated with the thighs extending horizontally to form a lap upon the two thighs, there is a very limited area at which to comfortably wear a pouch, without having the pouch uncomfortably encroach upon the pelvic joint at a lower end thereof, or upon the lower abdominal area below the navel, at an upper end thereof, especially if the wearer, typically male, has a protruding fatty deposit area colloquially referred to as a "beer belly", which puts an upper limit where a pouch can be comfortably placed.

Therefore, for an average adult, from the waist area where a belt is usually worn, to the front pelvic joint between the generally vertically extending lower abdominal wall and the horizontally extending thighs of a seated user's lap, there is only about five inches within which to situate a pouch.

In addition, in order to permit comfortable twisting of torso when turning while walking, it is advantageous to limit the horizontal width of the pouch, so that it remains generally flat and does not exceedingly bend, towards the medial pelvic area, especially for a woman where the pelvis is wider than a man's pelvis. Since most credit cards are less than four inches in width, and a typical passport is less than six inches in width when placed in a horizontal orientation, the size of the pouch should be limited to no more than six inches, preferably five inches, in horizontal width and no more than five inches, preferably four inches, in vertical height.

Since a collection a hotel key (either a traditional mechanical locking key or a flat electronic access key card), several credit cards, a health insurance card, photo identification and a passport together have a thickness when held together of less than one inch, it is desirable to wear a belt-worn pouch which is no more than one inch thick when full.

OBJECTS OF THE INVENTION

Persons live in times that are clouded by threats of terrorism. Because of this, travelers need to have their personal articles securely stored and easily accessible. It is therefore the object of this invention to provide a belt-worn pouch that provides security and comfort to the user and provides straightforward access to the contents.

SUMMARY OF THE INVENTION

In keeping with the aforesaid objects and others which may become apparent, the present invention includes an ergonomic, non-recoiling belt worn lower abdominal pouch, which is comfortable to wear, stays securely in place without bouncing and recoiling, and is secure from theft.

The lower abdominal pouch includes a front panel joined at a bottom edge thereof and along two side edges to a rear panel, forming an open pocket therebetween with a top entry. The top entry is closed by convenient traditional closures, such as a zipper, VELCRO hook and loop fasteners or a snap fastener. Optional the top may be further closed by a flap extending from the rear panel, over the open entry and over an upper part of the front panel.

Each panel is made of a flexible fabric or other synthetic or natural substrate material, such as canvas, leather and the like. The bottom and two side edges may be joined by traditional seams, such as by stitching or bonding.

The lower abdominal pouch is carried upon the wearer by being supported by the wearer's belt, which belt slides into a rear wall of the pouch, through a vertically extending button hole slot thereof and exits at a second button hole slot of a preferable outer rear wall in front of a preferable inner rear wall of the rear panel, thereby optionally providing a seal between the outer rear wall having the two open button hole slots for accommodating the user's belt therein.

Each button hole slot is no more than one and one half inches in height, to allow for a thick belt to enter smoothly therethrough and contains a stitched or otherwise reinforcing seam along the side edges thereof.

In order to hold a collection of a hotel key, such as a traditional mechanical locking key or a flat electronic access key card, several credit cards, a health insurance card, photo identification and a passport together, the lower abdominal pouch has a thickness when held together of less than one inch, when full.

The lower abdominal pouch is small enough to enable the wearer to carry the lower abdominal pouch in an anatomically convenient position in the lower front torso area.

The lower abdominal pouch takes into account the anatomical limitations of the human wearer of the pouch. The lower abdominal pouch is configured so as not to significantly intrude upon the lap area formed when a wearer is seated with the thighs extending horizontally to form a lap upon the two thighs.

As a result, the belt worn lower abdominal pouch of the present invention does not uncomfortably encroach upon the pelvic joint at a lower end thereof, or upon the lower abdominal area below the navel, at an upper end thereof.

Therefore, for an average adult, from the waist area where a belt is usually worn, to the front pelvic joint between the generally vertically extending lower abdominal wall and the horizontally extending thighs of a seated user's lap, the lower abdominal pouch is only about five inches, preferably four inches, in vertical height and about less than six inches, preferably five inches in width when placed in a horizontal orientation.

Since the ergonomic belt worn lower abdominal pouch can snugly fit between a user's pelvic joint joining the lower abdomen to the horizontally oriented thighs when the wearer is seated, it does not protrude outward significantly, and is not loosely suspended from carrying loops or other fastening holders, it does not annoyingly bounce and recoil back and forth when worn.

DESCRIPTION OF THE DRAWINGS

The present invention can best be understood in connection with the accompanying drawings, in which.

DETAILED DESCRIPTION

Figure 1:
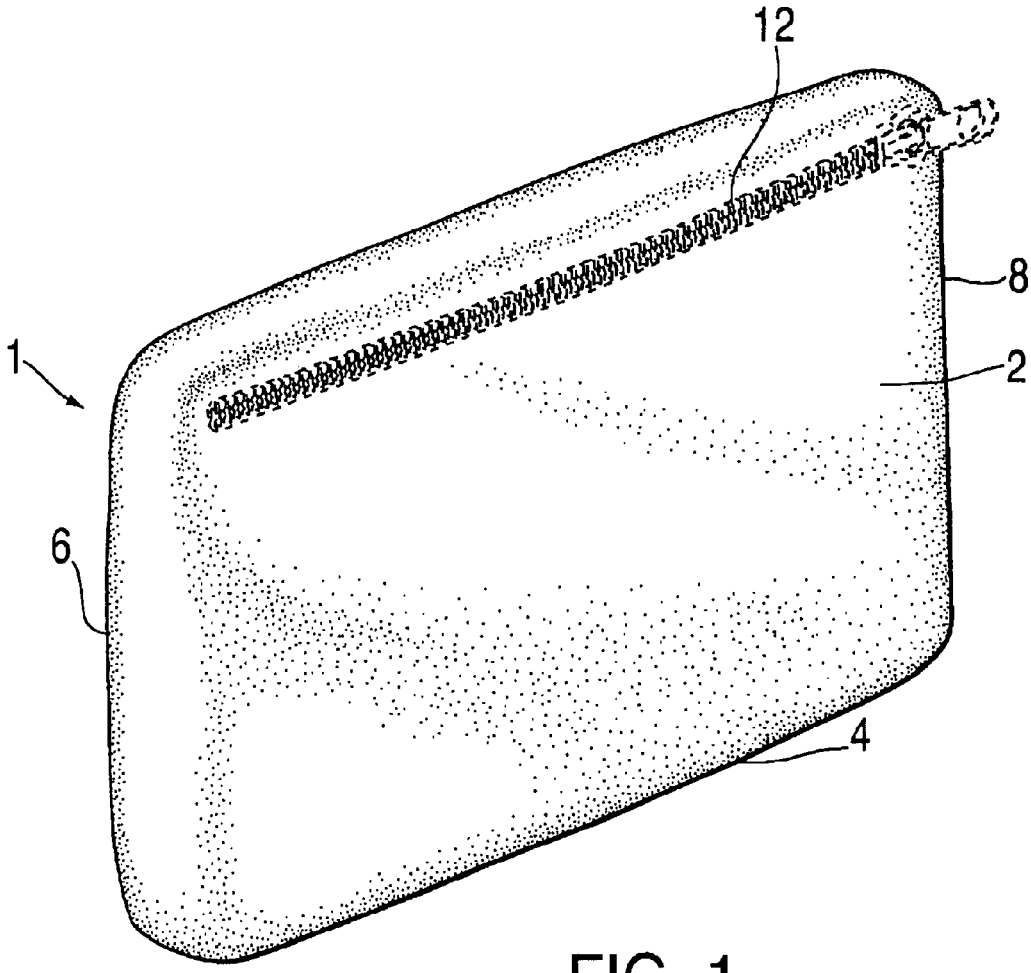
FIG. 1 is a perspective view of an ergonomic non-recoiling secure belt worn lower abdominal pouch of the present invention.
Figure 2:
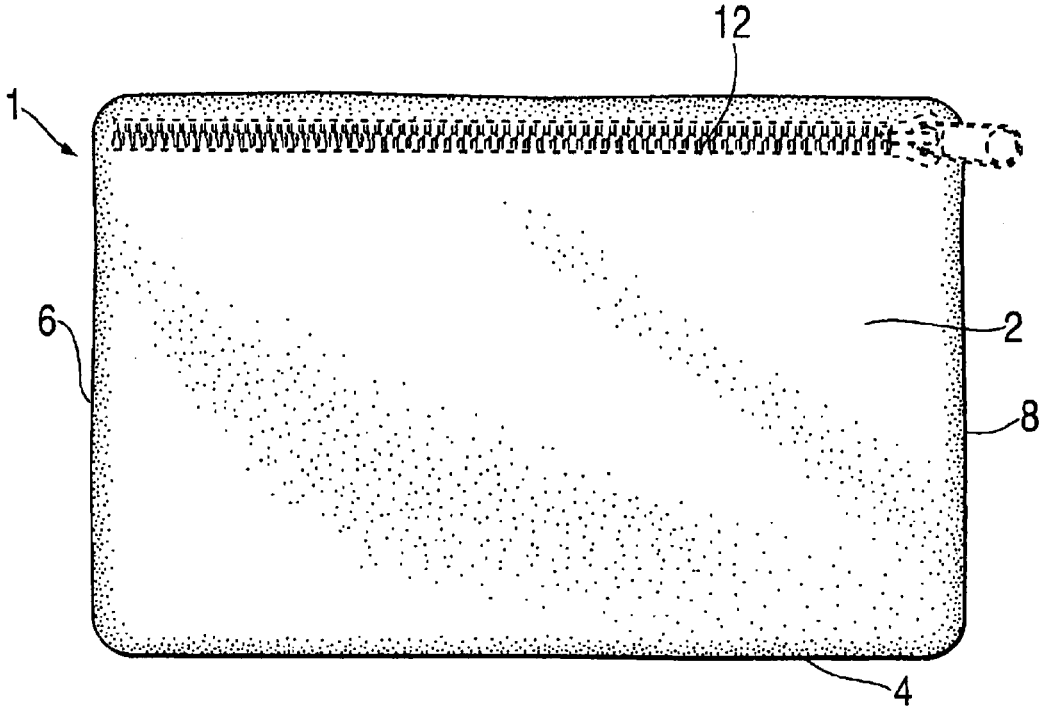
FIG. 2 is a front elevation view thereof.
Figure 3:
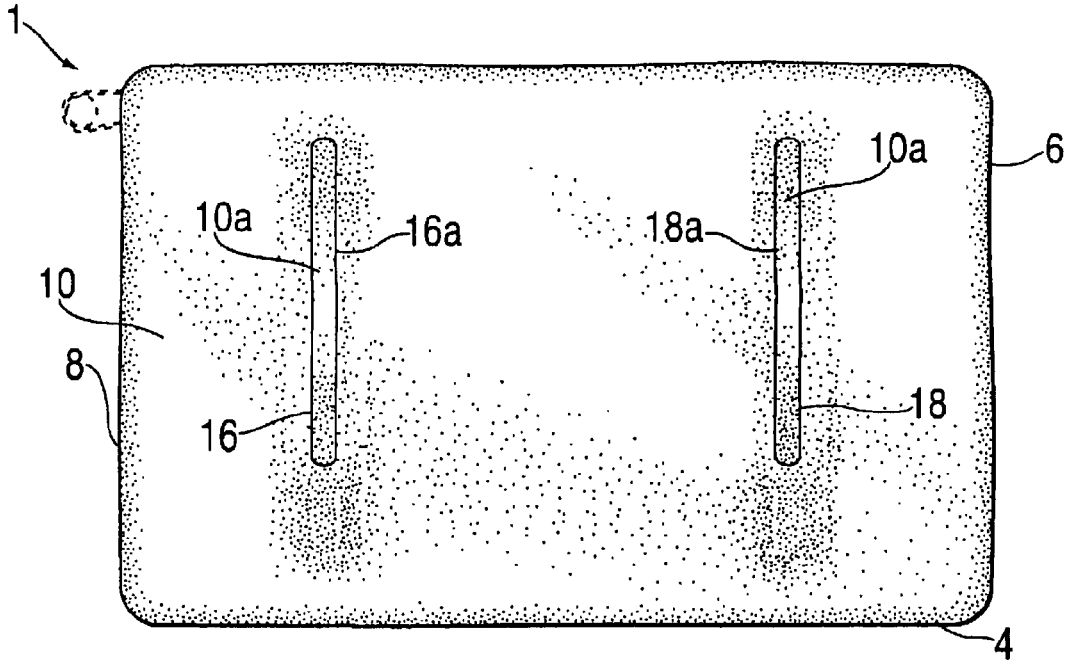
FIG. 3 is a rear view thereof.
Figure 4:
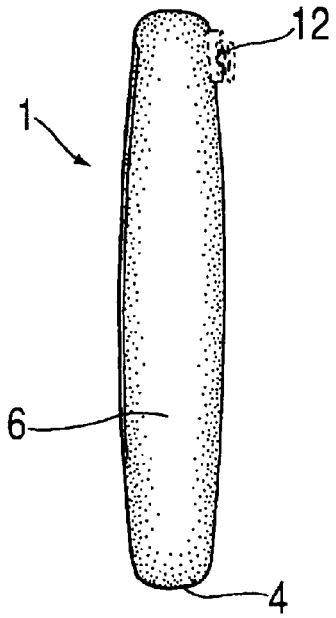
FIG. 4 is a left side elevational view thereof.
Figure 5:
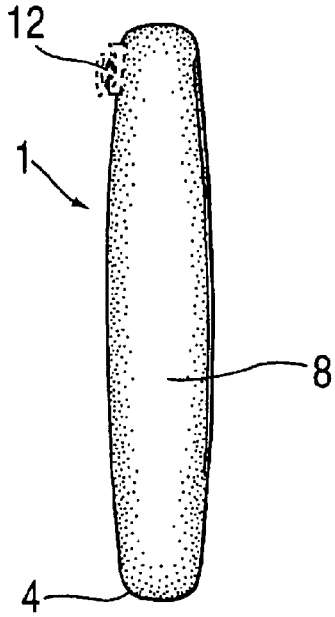
FIG. 5 is a right side elevational view thereof.
Figure 6:
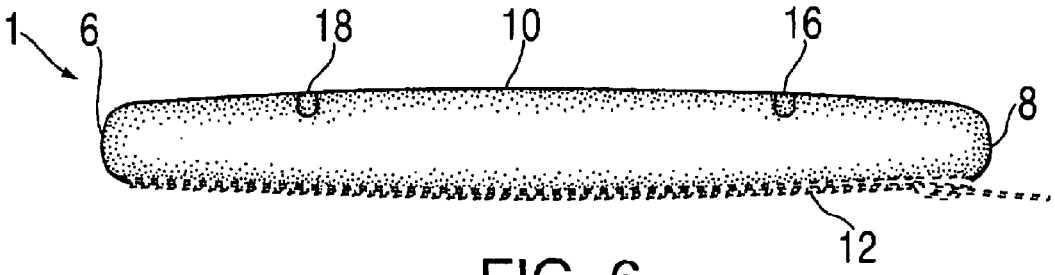
FIG. 6 is a top plan view thereof.
Figure 7:
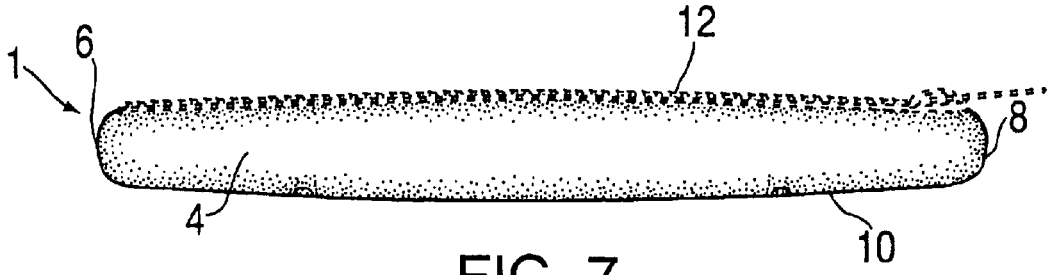
FIG. 7 is a bottom view thereof.
Figure 8:
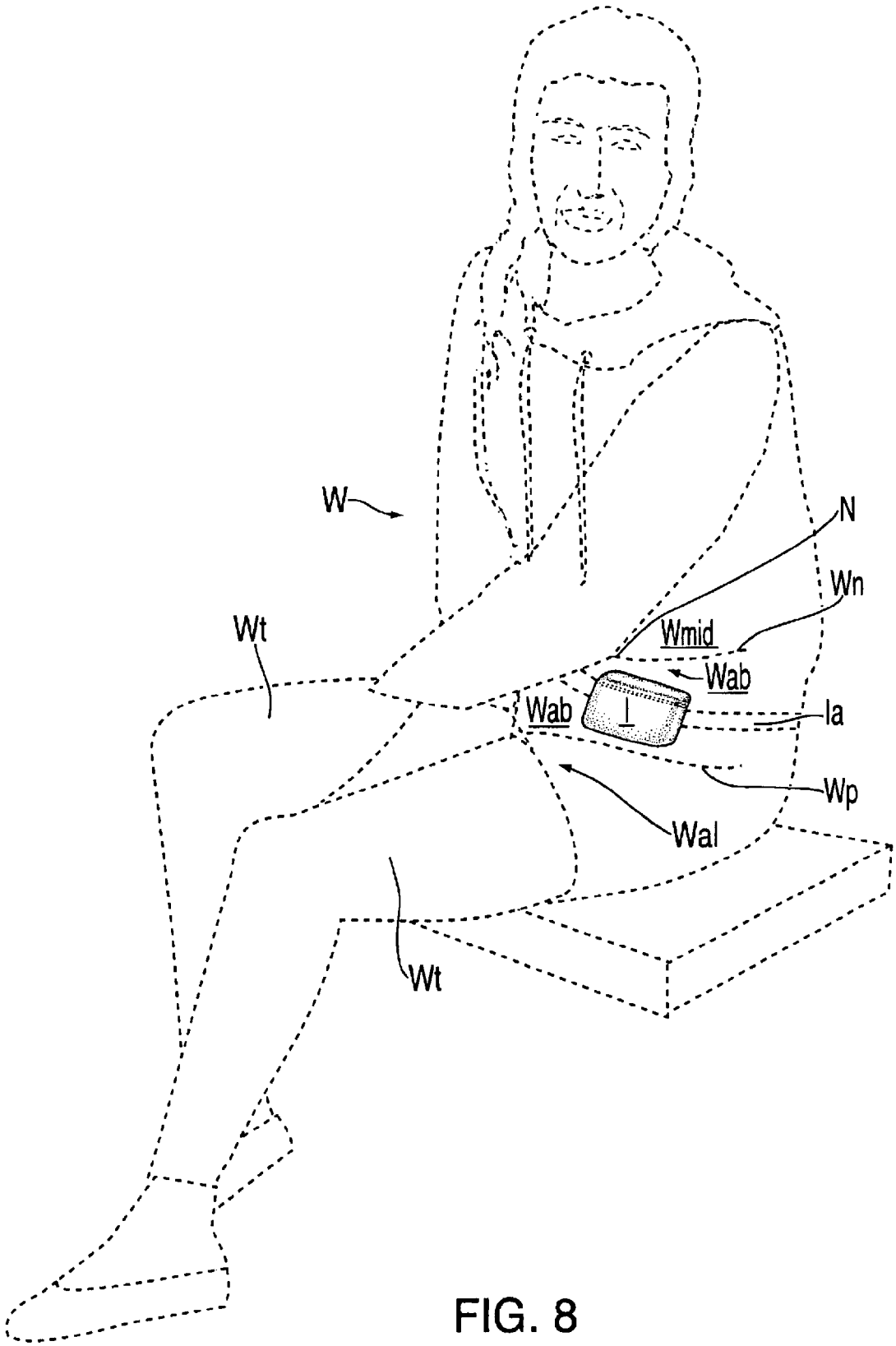
FIG. 8 is a perspective view thereof, shown worn upon a person.
Figure 9:
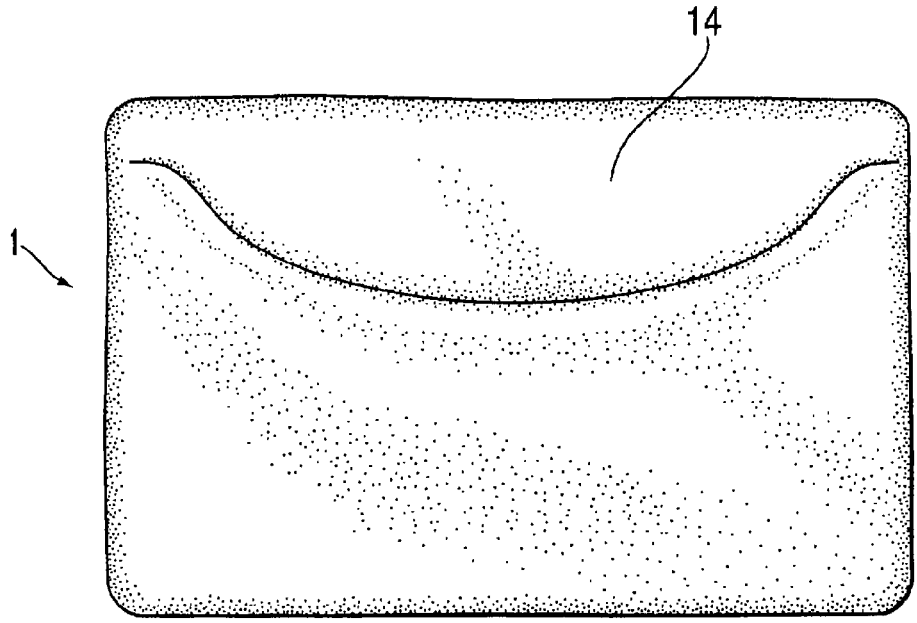
FIG. 9 is a front elevational view of an alternate embodiment thereof, shown with a closure flap on top of the closure fastener shown in FIG. 1–8.

As shown in drawing FIG. 1–8, the present invention includes ergonomic, non-recoiling belt worn lower abdominal pouch 1 including front panel 2 joined at a bottom edge 4 thereof and along two side edges 6 and 8 to a rear panel 10, forming an open pocket therebetween with a top entry. The top entry is closed by a convenient traditional closure 12, such as a zipper, VELCRO hook and loop fasteners or a snap fastener.

Optionally the top of lower abdominal pouch 1 may be further closed by a flap 14 extending from the top of rear panel 10, over the closure 12 and over an upper part of front panel 2.

Each panel 2 and 10 is preferably made of a flexible fabric or other synthetic or natural substrate material, such as canvas, leather and the like. The bottom edge 4 and two side edges 6 and 8 may also be joined by traditional seams, such as by stitching or bonding.

Lower abdominal pouch 1 is carried upon the wearer W by being supported by the wearer's belt 1*a*, which belt 1*a* slides into rear panel 10 of pouch 1, through a vertically extending button hole slot 16 thereof and exits at a second button hole slot 18 of outer rear panel 10 in front of a preferable inner rear wall 10*a* of rear panel 10, thereby optionally providing a seal between the outer rear panel 10 having the two open button hole slots 16, 18 for accommodating the user's belt 1*a* therein.

Each button hole slot 16 or 18 is preferably no more than one and three quarters inches in height, to allow for a thick belt 1*a* to enter smoothly therethrough and contains a stitched or otherwise reinforcing seam 16*a* or 18*a* along the side edges thereof.

In order to hold a collection of a hotel key, such as a traditional mechanical locking key or a flat electronic access key card, several credit cards, a health insurance card, photo identification and a passport together, lower abdominal pouch 1 has a thickness when held together of less than one inch, when full.

Lower abdominal pouch 1 is small enough to enable the wearer to carry lower abdominal pouch 1 in an anatomically convenient position in the lower front torso area of the wearer's body.

Lower abdominal pouch 1 takes into account the anatomical limitations of the human wearer of lower abdominal pouch 1. Lower abdominal pouch 1 is limited to be positioned within a predefined anatomical area defined as lower abdominal area Wab, formed between an imaginary line Wn extending from the navel N of wearer W and an imaginary line Wp formed at a pelvic joint separating the generally vertically extending lower abdominal area Wab and the generally horizontally extending lap area Wal. Therefore, lower abdominal pouch 1 is configured so as not to significantly intrude upon the lap area Wal formed when a wearer W is seated with the thighs Wt extending horizontally to form a lap Wal upon the two thighs Wt.

As a result, the lower end of belt worn lower abdominal pouch 1 does not uncomfortably encroach upon the pelvic joint Wp, at the beginning of lap area Wal extending across thighs Wt.

Furthermore, lower abdominal pouch 1 lays within lower abdominal area Wab, below the imaginary line Wn extending horizontally from the navel N, at an upper end of lower abdominal area Wab, and does not extend into the mid abdominal area Wmid above the navel.

Therefore, for an average adult, from the waist area where a belt 1*a* is usually worn, to the front pelvic joint between the generally vertically extending lower abdominal wall Wab and the horizontally extending thighs Wt of a seated user's lap, lower abdominal pouch 1 is less than about four inches in vertical height and less than about five and one half inches in width when placed in a horizontal orientation upon wearer W.

Since ergonomic belt worn lower abdominal pouch 1 can snugly fit between a user's pelvic joint joining the lower abdomen Wab to the horizontally oriented thighs Wt when the wearer W is seated, it does not protrude outward significantly, and is not loosely suspended from carrying loops or other fastening holders. It also does not annoyingly bounce and recoil back and forth when worn.

Other embodiments may be made within the scope of the present invention, as noted in the appended claims.

I claim:

1. An ergonomic, non-recoiling belt worn lower abdominal pouch, which is comfortable to wear, stays securely in place upon a waist-worn belt of a wearer, without bouncing and recoiling, and is secure from theft, comprising:

a front panel joined by respective seams at a bottom edge thereof and along two side edges thereof to a rear panel, forming an open pocket therebetween;

said open pocket having a top entry at a top upper end thereof;

said top entry being openable and closable by a closure member;

each said panel being made of a flexible material;

said lower abdominal pouch being carried upon the wearer by being supported by the wearer's belt, which belt slides into said rear panel of said lower abdominal pouch, through a vertically extending button hole slot thereof and exits at a second button hole slot of said rear panel said lower abdominal pouch having a thickness when filled of less than one inch, about four to five inches in vertical height and about five to six inches in width;

said lower abdominal pouch being small enough to enable the wearer to carry said pouch in an anatomically convenient position in the lower front torso area;

said lower abdominal pouch being configured so as not to significantly intrude upon the lap area formed when the wearer is seated with the thighs extending horizontally to form a lap upon the two thighs said lower abdominal pouch not encroaching upon a pelvic joint of the wearer at a lower end thereof, and upon the lower abdominal area below the navel, at an upper end thereof.

2. The ergonomic, non-recoiling belt worn lower abdominal pouch as in claim 1 wherein said top entry closure is a zipper.

3. The ergonomic, non-recoiling belt worn lower abdominal pouch as in claim 1 wherein said top entry is further closable by a flap extending from said rear panel, over said open top entry and over an upper part of said front panel.

4. The ergonomic, non-recoiling belt worn lower abdominal pouch as in claim 1 wherein said pouch comprises a flexible fabric or other synthetic or natural substrate material, such as canvas, leather and the like.

5. The ergonomic, non-recoiling belt worn lower abdominal pouch as in claim 1 wherein said pouch comprises a flexible synthetic material.

6. The ergonomic, non-recoiling belt worn lower abdominal pouch as in claim 1 wherein said pouch comprises a flexible natural substrate material.

7. The ergonomic, non-recoiling belt worn lower abdominal pouch as in claim 1 wherein said rear panel comprises an outer wall perforated by said buttonhole slots, and an inner wall providing a seal between said outer rear wall having said open button hole slots accommodating the wearer's belt therein.

8. The ergonomic, non-recoiling belt worn lower abdominal pouch as in claim 1 wherein each said button hole slot is no more than one and one half inches in height.

9. The ergonomic, non-recoiling belt worn lower abdominal pouch as in claim 1 wherein each said button hole slot contains a reinforcing seam along respective side edges thereof.

10. The ergonomic, non-recoiling belt worn lower abdominal pouch as in claim 1 wherein said lower abdominal pouch is configured so as not to significantly intrude upon the waist area below the navel of the wearer at an upper end of said lower abdominal pouch and at the wearer's pelvic joint joining said lower abdominal area to said joint, joining said lower abdominal area to the horizontally extended thighs of the wearer when seated.

11. A method of carrying objects comfortably upon the body of a person, comprising the steps of:

providing an ergonomic, non-recoiling belt worn lower abdominal pouch, securely in place upon a waist-worn belt of a wearer, without bouncing and recoiling, said lower abdominal pouch having a front panel joined by respective seams at a bottom edge thereof and along two side edges thereof to a rear panel, forming an open pocket therebetween;

said open pocket having a top entry at a top upper end thereof;

said top entry being openable and closable by a closure member;

each said panel being made of a flexible material;

said lower abdominal pouch being carried upon the wearer by being supported by the wearer's belt, which belt slides into said rear panel of said lower abdominal pouch, through a vertically extending button hole slot thereof and exits at a second button hole slot of said rear panel;

said lower abdominal pouch having a thickness when filled of less than one inch, about four to five inches in vertical height and about five to six inches in width;

said lower abdominal pouch being small enough to enable the wearer to carry said pouch in an anatomically convenient position in the lower front torso area;

said lower abdominal pouch being configured so as not to significantly intrude upon the lap area formed when the wearer is seated with the thighs extending horizontally to form a lap upon the two thighs said lower abdominal pouch not encroaching upon a pelvic joint of the wearer at a lower end thereof, and upon the lower abdominal area below the navel, at an upper end thereof; and, said lower abdominal pouch being configured so as not to significantly intrude upon the waist area below the navel of the wearer at an upper end of said lower abdominal pouch and at the wearer's pelvic joint joining said lower abdominal area to said joint joining said lower abdominal area to the horizontally extended thighs of the wearer when seated.

* * * * *